United States Patent [19]

Strange

[11] 4,264,055

[45] Apr. 28, 1981

[54] STRETCHING TOOL

[76] Inventor: John A. Strange, 3519 Gardenia St., Anderson, Calif. 96007

[21] Appl. No.: 80,240

[22] Filed: Oct. 1, 1979

[51] Int. Cl.[3] ..... B66F 3/00

[52] U.S. Cl. ..... 254/243

[58] Field of Search ..... 254/77, 83, 243

[56] References Cited

U.S. PATENT DOCUMENTS

| | | | |
|---|---|---|---|
| 740,630 | 10/1903 | Darst | 254/77 |
| 748,697 | 1/1904 | Bush | 254/77 |
| 838,481 | 12/1906 | Waller | 254/77 |
| 869,402 | 10/1907 | Weyant | 254/77 |
| 1,317,145 | 9/1919 | Skantz | 254/77 |
| 1,637,587 | 8/1927 | Peltz | 254/77 |

*Primary Examiner*—Robert C. Watson

*Attorney, Agent, or Firm*—Blair, Brown & Kreten

[57] ABSTRACT

Disclosed herein is a tool for stretching wire and similar such devices commonly used in the repair or fabrication of wire fencing. The structure according to the present invention is defined by a pivot point, an arcuate handle attached to the pivot point and opposed hooks disposed at extremities of the handle whereby the wire can be tensioned and refastened to a post with only one person operating the tool and reaffixing the wire.

4 Claims, 3 Drawing Figures

1
2
3
4
5
6
7
8
9
10
P
W

STRETCHING TOOL

BACKGROUND OF THE INVENTION

Wire working tools have been known for some time, and the various wire stretching tools of which applicant is aware include the following:

| | |
|---|---|
| 1,268,364 Larson | 2,996,283 Johnson |
| 1,930,005 Forsythe | 3,655,165 Wright |
| 2,486,883 Ruffin | |

Ruffin appears to be closest to the invention but can be physically distinguished from the instant application by noting the structure associated therewith requires the efforts of two people to retension the fence, defines a structure more complex than the instant application, and does not provide the flexibility of being workable with many different kinds of wire without substantial modification of the wire grasping mechanism.

The rest of the references bear even fewer physical similarities.

BRIEF SUMMARY OF THE INVENTION

Accordingly, the ensuing detailed specification and claims are directed to a wire stretching tool which can be used by one person.

A further object contemplates providing a wire stretching tool which acts on the horizontal top rail of cyclone or other top rail supported fences, or on the fence posts vertical extremity in contra-distinction to the prior art which uses the side portion of the posts.

A further object contemplates a wire stretching tool which is easy to use and is durable in construction.

A further object contemplates providing a wire stretching tool which is economical to manufacture and adjustable for accomodating and providing different amounts of wire tension.

A further object contemplates providing a device that is appropriate for and efficient in fencing smaller spans (2–10 feet) where the usual procedure requires two come-a-longs.

A still further object contemplates providing a wire stretching tool that is particularly adept in constructing small gates (3–4 feet wide).

These and other objects will be made manifest when considering the ensuing detailed specification and claims.

DESCRIPTION OF THE PREFERRED EMBODIMENT

Figures 1, 2, 3:
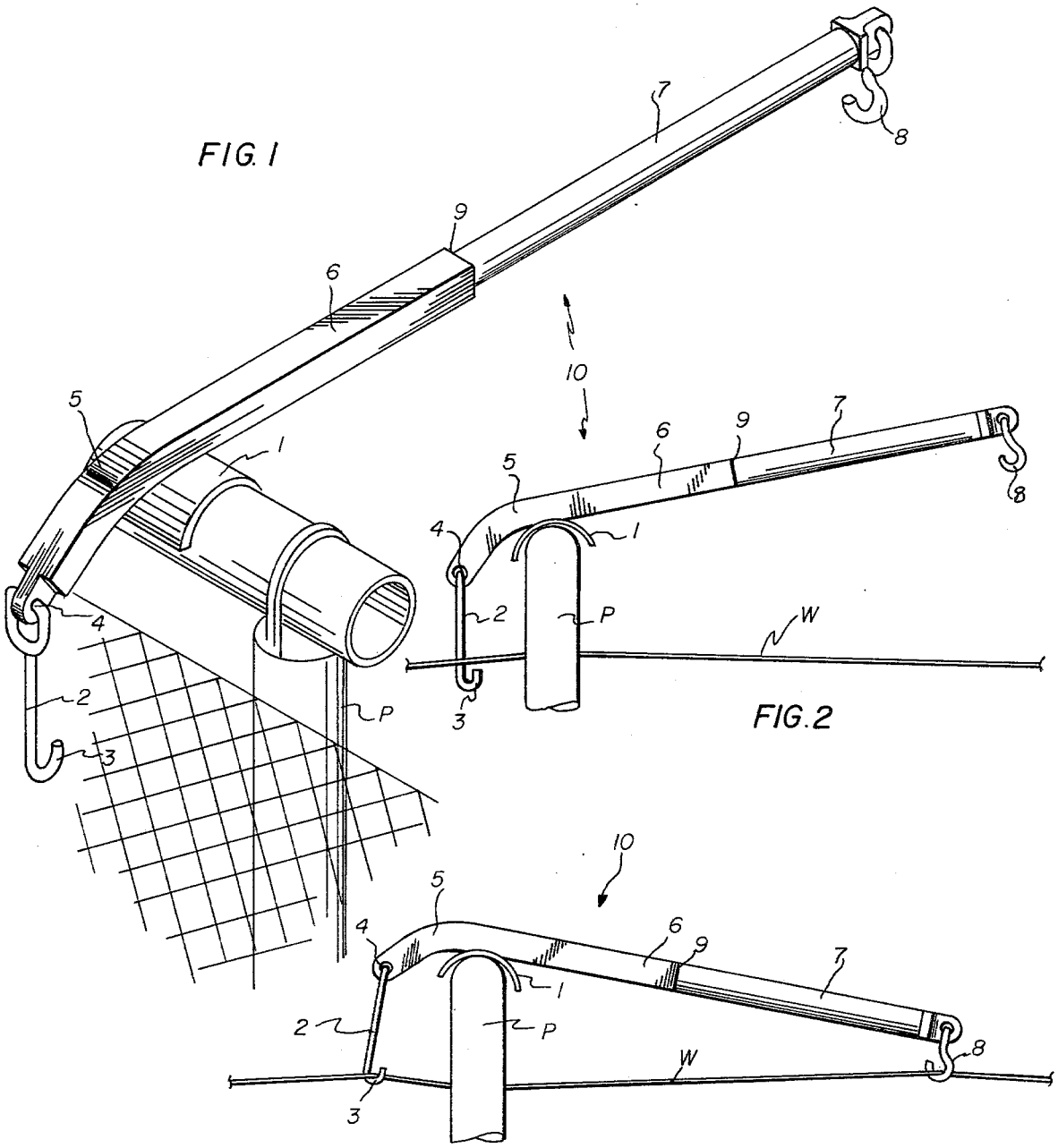
FIG. 1 is a perspective view of the apparatus according to the present invention.
FIG. 2 is a side view thereof in which a piece of wire is about to get stretched.
FIG. 3 shows the wire stretching tool actually stretching the wire.

Referring to the drawings now, wherein like reference numerals refer to like parts, reference numeral 10 is directed to the wire stretching tool of the present invention. The tool 10 is defined by an arcuate cup 1 which serves to nest or be supported upon the vertical extremity of a post P or top rail R which supports or is to support the wire W. One extremity of the tool 10 has an arcuate portion 5 which terminates in a pivot point or open area 4 which depends therefrom a hook 2 having a J end 3. Beyond the arcuate portion 5 is a rectangular medial portion 6 which overlies the arcuate pivot cup 1 that mounts upon the top of the post P or upon the horizontal top rail R, and the rectangular portion terminates at an extremity remote from the arcuate portion 5 in a circular handle 7 having a hook 8 at its terminus remote from the J hook 3. The area between the square portion 6 of the handle and the round portion 7 bears the legend 9 and this may be a telescoping interconnection or a friction fit as desired or may even be threaded therein so that the length of the arms 6 and 7 can be varied to provide different amounts of torque on the wire W.

It is apparent therefore that to use the device according to the present invention the J hook 3 engages the wire W, the arcuate cup 1 overlies the post P or top rail R and the handle 7 is depressed or pivoted downwardly so that the hook 8 can engage the wire W on the opposite side from the J hook 3. The wire W then is sufficiently tensioned that one can let go of the handle of stretching tool 10 and proceed to attach the wire W on to the post P or top rail R single handed.

Having thus described the invention, it should be apparent that numerous structural modifications are contemplated as being a part of this invention as set forth hereinabove and as defined hereinbelow by the claims.

What is claimed is:

1. A wire stretching tool comprising a handle having an arcuate portion at one extremity thereof, a post support cup disposed on said handle near said arcuate portion, and hook means at opposed remote extremities of said handle whereby said hook means closest to said post support cup serves to tension by grasping a wire disposed on a post, or to elevate by grasping wire mesh or fabric up to a desired position to fasten to a top rail, and said hook means at the opposed extremity serves to lock said wire stretching tool in position by engagement with the wire, mesh or fabric whereby one person can fasten the wire to the post or top rail after locking the handle onto the wire.

2. The device of claim 1 in which said arcuate portion of the handle is provided with a pivot point from which depends an elongate hook terminating in a J which defines a first of said hook means.

3. The device of claim 2 in which said handle above said post support cup has a generally rectangular portion, and said handle which extends away from said first hook means forms into a circular handle portion.

4. The device of claim 3 in which the area between said rectangular portion and said circular portion can be caused to telescope.

* * * * *